United States Patent [19]

Lewis

[11] Patent Number: 4,898,150

[45] Date of Patent: Feb. 6, 1990

[54] PRESSURE BALANCING WATER HEATER DIP TUBE TURBULATOR ATTACHMENT

[75] Inventor: Brian Lewis, Guelph, Canada

[73] Assignee: GSW Inc., Toronto, Canada

[21] Appl. No.: 321,876

[22] Filed: Mar. 10, 1989

[51] Int. Cl.[4] ..... F24H 1/00

[52] U.S. Cl. ..... 126/361; 122/13 R

[58] Field of Search ..... 126/360, 361; 122/13–19; 239/567, 568, 524

[56] References Cited

U.S. PATENT DOCUMENTS

| | | | |
|---|---|---|---|
| 1,646,299 | 10/1927 | Mandry | 239/568 |
| 2,123,809 | 7/1938 | Seitz | 122/13 R |
| 3,001,724 | 9/1961 | Osborne | 239/568 |
| 3,762,395 | 10/1973 | Taylor | 126/361 |
| 4,817,564 | 4/1989 | Akkala et al. | 126/361 |

*Primary Examiner*—Carroll B. Dority

[57] ABSTRACT

The present invention relates to an end piece for a water heater dip tube which converts the dip tube from primarily a water feed only, to a combination water feed and turbulator. The end piece comprises an end face at right angles to the water flow through the dip tube with openings radially around the end face and the openings being symmetrically positioned for balanced pressure water flow to all sides of the end piece thereby eliminating directional torque on the dip tube itself.

6 Claims, 2 Drawing Sheets

PRESSURE BALANCING WATER HEATER DIP TUBE TURBULATOR ATTACHMENT

FIELD OF THE INVENTION

The present invention relates to an end piece for converting a water heater dip tube to a combination water feed and turbulator.

BACKGROUND OF THE INVENTION

As a result of ongoing inflow of water over an extended period of time into a water heater, sediment tends to gather and build up in the bottom of the water heater. This sediment adversely affects performance particularly with respect to heating of the water in the water heater.

Until recently, only limited water heater developments have been made in an attempt to reduce the sediment build up problem. The developments that have been made, are in the form of turbulating devices, e.g. devices designed to cause a turbulation or swirling of the sedimet at the bottom of the tank so that it can then be drained from the tank.

There are primarily two different types of water feeds to a conventional water heater. One of these water feeds is provided through a radial inlet near the base of the water heater. A specific type of turbulator has been designed for the base inlet water heater and this turbulator is in the form of a large ring having a series of venturi like openings around the ring.

The other type of water heater feed is through a dip tube which is a plastic pipe extending axially from the top down into the water heater. A specific turbulator attachment as shown in Canadian Pat. No. 922,597 to Taylor issued Mar. 13, 1973 has been previously designed for the dip tube water feed.

In principle, the Taylor design, is effective for turbulating the sediment at the bottom of the water heater. However, from a practical standpoint, the turbulator device of Canadian Pat. No. 922,597 places a torque factor on the dip tube which because of both its plastic construction and its extended length is not particularly suited to stand up to any type of a bending force. Added to this is the fact that the Taylor turbultor is specifically designed to provide a venturi unidirectional high speed water flow at right angles to the axis of the dip tube making it very susceptible to breaking.

SUMMARY OF THE PRESENT INVENTION

The present invention provides an end piece for a water heater dip tube which converts the dip tube from a water feed primarily to a combination water feed and turbulator. In contrast to the Taylor turbulator, the end piece of the present invention is designed to create a water swirl at the bottom of the water heater without placing any radial torque or pressure on the dip tube.

More particularly, the present invention comprises an end piece for a dip tube having an end face at right angles to the axis of the dip tube and openings radially around the end piece above the end face. The openings are symmetrically positioned for a balanced pressure water flow radially of the end piece.

According to one aspect of the present invention, the end piece is in the form of a fitting or attachment to an otherwise standard dip tube.

According to another aspect of the present invention, the dip tube itself is built with the end piece as an integral part of the dip tube.

BRIEF DESCRIPTION OF THE DRAWINGS

The above as well as other advantages and features of the present invention will be described in greater detail according to the preferred embodiments of the present invention in which.

Figure 1:
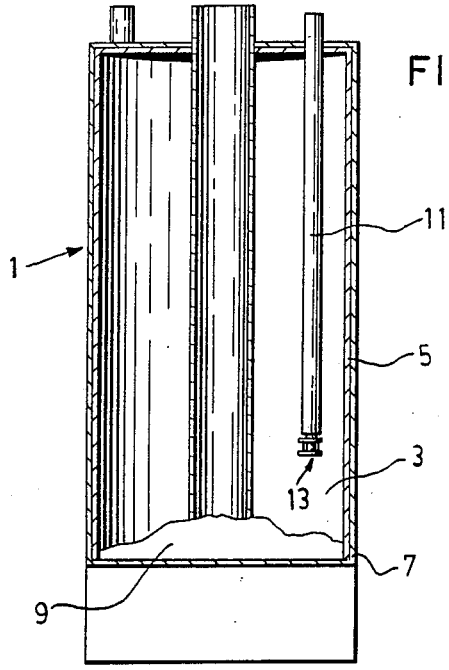
FIG. 1 is a sectional view through a water heater having a dip tube turbulator according to a preferred embodiment of the present invention.

DETAILED DESCRIPTION ACCORDING TO THE PREFERRED EMBODIMENTS OF THE PRESENT INVENTION IN WHICH:

FIG. 1 shows a water heater generally indicated at 1. This water heater has an internal water reservoir 3, defined by a cylindrical inner wall 5 which includes a bottom wall 7. As will be seen in FIG. 1, sediment 9 collects on the bottom wall and as described above adversely affects performance of the water heater.

A dip tube 11 is provided as a water feed. This dip tube extends downwardly through the top wall and well down into the water heater so that the cold water is introduced through the dip tube for heating in the lower part of the water heater after which it then rises upwardly to be drawn off from the water heater.

Dip tube 11 conventionally has a plastic construction so that it will not deteriorate within the water heater. This plastic construction provides the benefit that the dip tube is extremely light in weight, but this also presents a drawback for receiving a turbulator such as that described in Canadian Pat. No. 922,597 in that the dip tube is not intended to stand up to any bending forces at right angles to the length of the dip tube.

Figure 3:
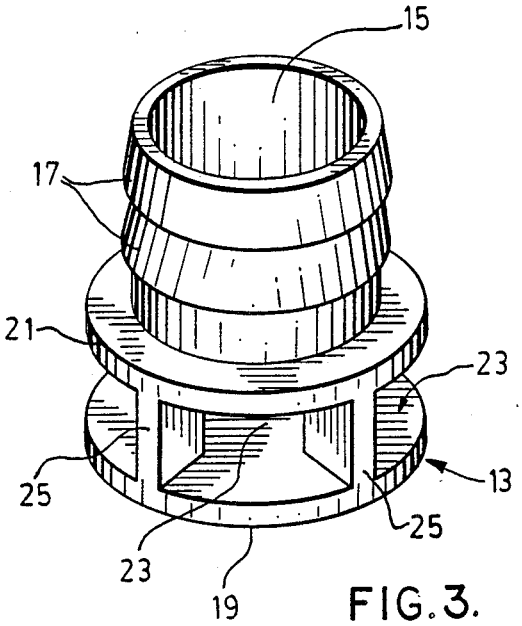
FIG. 3 is an enlarged perspective view of the turbulator fitting as attached to the dip tube of FIG. 1.
Figure 4:
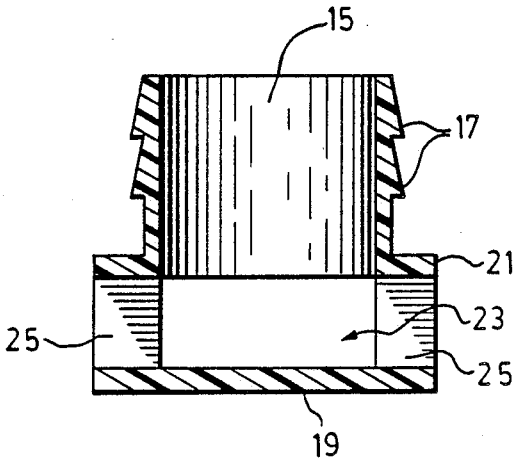
FIG. 4 is a sectional view through the turbulator fitting of FIG. 3.

In accordance with the present invention dip tube 11 is fitted with an end piece generally indicated at 13. The preferred embodiment for this end piece is shown in FIGS. 3 and 4 of the drawings where the end piece is a turbulator fitting which is secured to the lower end of the already existing dip tube. However, as noted above the dip tube can also be built with an end piece as an integral part of the dip tube.

Turbulator fitting 13, comprises a neck portion 15, having a wedged exterior surface 17. The wedges on the exterior surface of the neck portion are downwardly, outwardly cammed, as best seen in FIG. 4 of the drawings, which allows a force fitting of the turbulator fitting telescopically in the dip tube.

Provided at the bottom of the turbulator or end fitting is a stop face 19, which is at right angles to the axis of the neck portion which is in turn in alignment with the axis of the dip tube. End face 19, is in the form of a solid circular plate as best seen in FIG. 3 of the drawings.

Provided immediately around the base of the neck portion is a radial flange 21. This radial flange provides a stop which abuts against the bottom of the dip tube with neck portion 15 fully inserted in the dip tube.

End face 19 is supported from radial flange 21 by a plurality of partition-like support members 25 around the fitting. These support members are set at outwardly diverging angles equidistantly from one another to define a plurality of openings 23 which open sideways symmetrically around the fitting.

As a result of the symmetry of the openings 23 there is a balanced pressure water flow out of the fitting and balanced pressure to all sides of the dip tube.

Note that the turbulator fitting is very short with almost no effect on the length of the dip tube so that it can be attached to all presently available dip tubes which terminate short of the bottom of the water heater.

Figure 2:
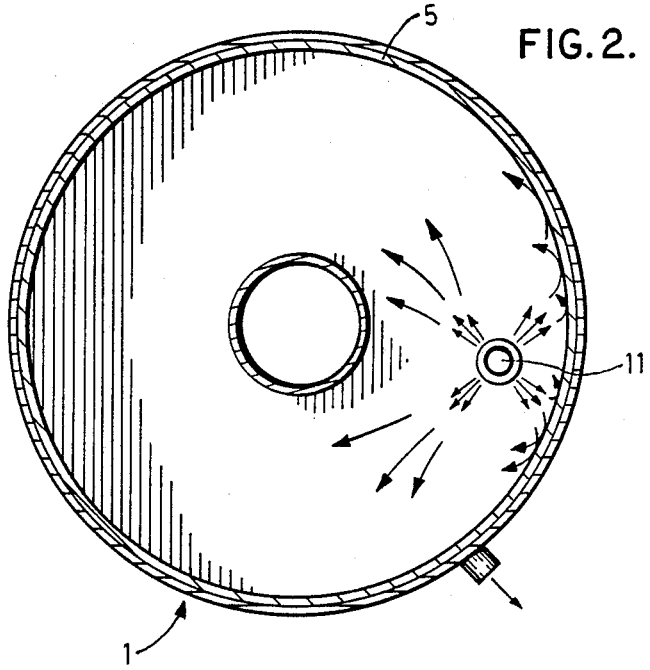
FIG. 2 is a top view looking down through the water heater of FIG. 1.

The operation of the dip tube with the turbulator fitting in position is best described having reference to FIGS. 1 and 2 of the drawings. The water feed enters downwardly along the dip tube, through the neck portion of the fitting and impacts solid plate end face 19. From here, the water is directed radially with a balanced pressure to all sides of the fitting as seen in FIG. 2 of the drawings. This flow of water from the turbular device occurs tangentially of the interior of the water heater and causes a swirl or turbulating effect acting on the sediment which then tends to remain in suspension as water is drawn off from the water heater.

One particularly unique feature that is provided by both the positioning of the dip tube in relatively close proximity to the interior water heater wall 5, and the radial flow of water from the turbulator is that wall 5 actually assists, because of its curvature, in the turbulating action as best seen in FIG. 2 of the drawings. The water flowing from the fitting impacts the wall which redirects the water circumferentially of the interior of the tank to assist in the turbulating action.

It is to be noted that although the drawings show the use of a turbulator in a gas water heater it works equally as well in an electric water heater. Furthermore, the turbulator, regardless of the type of water heater in which it is used, assists in stratification of water in the heater which maximizes efficiency of the operation of the water heater.

It will now be seen how a dip tube provided with a turbulating end piece having symmetrical side openings results in a balanced pressure flow from the water tube and eliminates or at least substantially eliminates any unwanted bending pressures on the dip tube. Furthermore, although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A water heater comprising a tank having a bottom wall and a plastic water feed dip tube extending along a vertical axis downwardly into said tank towards and having a lower end terminating near said bottom wall, said lower end of said dip tube comprising a turbulator including an end plate with a flat upper surface at right angles to said vertical axis and a plurality of water flow openings immediately above said flat upper surface of said end plate, said water flow openings being positioned symmetrically at all sides around said dip tube such that water fed into said tank through said dip tube impinges on said flat upper surface of said end plate and is redirected as a balanced flow sideways in all directions out of said water flow openings to cause a swirling effect of the redirected water maintained near the bottom end of the tank and agitating any sediment settled thereon.

2. A water heater as claimed in claim 1, wherein said water heater has a rounded inerior tank sidewall, said plastic dip tube being positioned adjacent said sidewall whereby the redirected water flows onto said sidewall which further redirects the water in a circular pattern to enhance the swirling effect of the water near the bottom end of the tank.

3. A water heater as claimed in claim 1, wherein said end plate is secured to said dip tube by a plurality of thin partition-like support members, said support members being set at corresponding outwardly diverging angles equidistantly from one another around said turbulator and causing an outwardly diverging sideways spreading flow of water through each of said water flow openings.

4. A water heater as claimed in claim 1, wherein said turbulator comprises a separate plastic end piece secured solely by a plastic to plastic wedge fit between said plastic dip tube and said plastic end piece.

5. A water heater as claimed in claim 4, wherein said turbulator includes a neck portion fitted interiorly of said dip tube, said neck portion having a wedged exterior surface binding on said dip tube.

6. A method of turbulating sediment in a water heater comprising a tank having a bottom wall and a plastic water feed dip tube extending along a vertical axis downwardly into said tank towards and having a lower end terminating near said bottom wall, said lower end of said dip tube comprising a turbulator device including an end plate with a flat upper surface at right angles to said vertical axis and a plurality of water flow openings immediately above said flat upper surface of said end plate, said water flow openings being positioned symmetrically at all sides around said dip tube, said method comprising feeding water down said dip tube, redirecting the water as a balanced flow sideways in all directions out of said water flow opening and producing a swirling effect at and near the bottom of said tank to agitate any sediment settled thereon.

* * * * *